United States Patent [19]

Gragg et al.

[11] 4,448,249

[45] May 15, 1984

[54] METHOD OF IN SITU OIL SHALE RETORT IGNITION WITH OXYGEN CONTROL

[75] Inventors: Frederick M. Gragg, Seabrook, Tex.; Jian C. Shen, Santa Ana, Calif.; Carl L. Jacobson, Rifle, Colo.

[73] Assignee: Occidental Research Corporation, Irvine, Calif.

[21] Appl. No.: 389,847

[22] Filed: Jun. 18, 1982

[51] Int. Cl.[3] ..... E21B 43/247; E21B 47/06

[52] U.S. Cl. ..... 166/251; 166/259; 299/2

[58] Field of Search ..... 166/251, 256, 259, 260; 299/2

[56] References Cited

U.S. PATENT DOCUMENTS

| | | | |
|---|---|---|---|
| 3,032,102 | 5/1962 | Parker | 166/251 |
| 3,952,801 | 4/1976 | Burton | 166/256 |
| 4,027,917 | 6/1977 | Bartel et al. | 166/259 X |
| 4,245,701 | 1/1981 | Chambers | 166/260 X |
| 4,369,841 | 1/1983 | Cha | 166/251 |

*Primary Examiner*—George A. Suchfield

*Attorney, Agent, or Firm*—Christie, Parker & Hale

[57] ABSTRACT

A method for recovering liquid and gaseous products from an in situ oil shale retort containing a fragmented permeable mass of formation particles containing oil shale is provided. A hot ignition gas comprising oxygen at a first selected concentration is introduced into the fragmented mass for heating the fragmented mass top surface. The percentage of the fragmented mass top surface that is at a temperature no less than the ignition temperature of oil shale is determined. Thereafter, the concentration of oxygen in the ignition gas is increased by an amount proportional to the determined percentage. Such heating of the fragmented mass top surface establishes a combustion zone in the retort. After the combustion zone has spread horizontally across the retort, introduction of the hot ignition gas is discontinued. Thereafter, an oxygen-supplying gas is introduced into the retort for advancing the combustion zone downwardly through the fragmented mass. Liquid and gaseous products are produced in a retorting zone on the advancing side of the combustion zone and are recovered.

31 Claims, 1 Drawing Figure

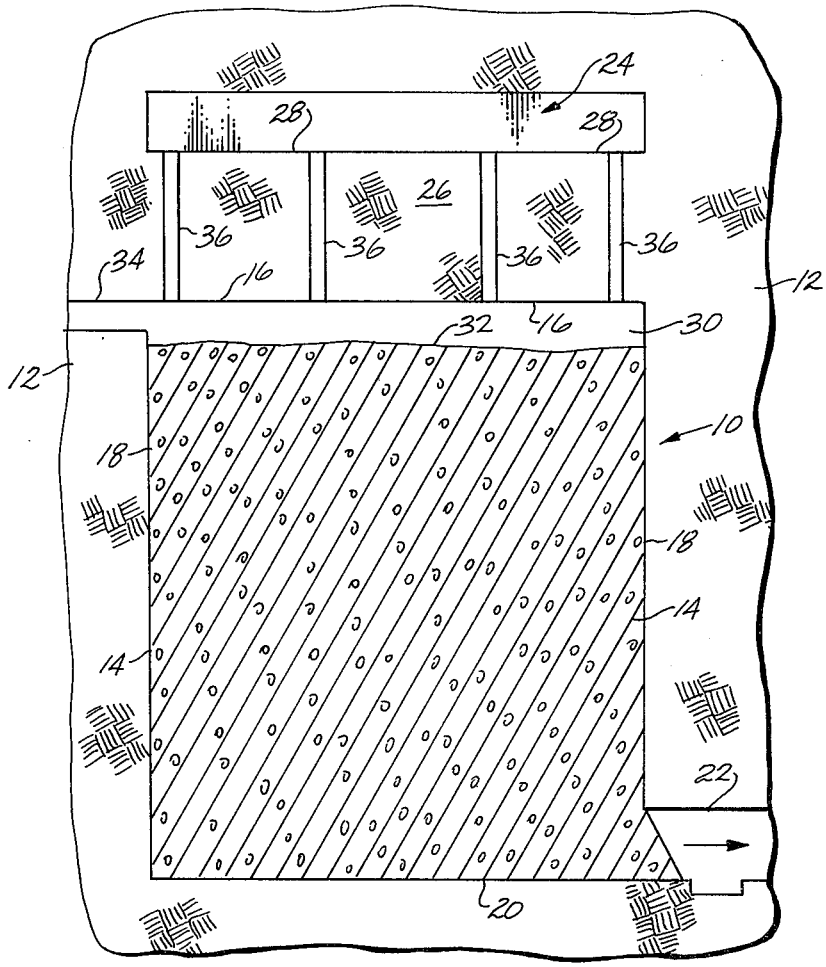
24
28
28
26
36
36
36
36
34
16
16
12
32
30
12
10
18
18
14
14
22
20

METHOD OF IN SITU OIL SHALE RETORT IGNITION WITH OXYGEN CONTROL

FIELD OF THE INVENTION

This invention relates to processing of oil shale and, more particularly, to a method for igniting oil shale in an in situ oil shale retort.

BACKGROUND OF THE INVENTION

The presence of large deposits of oil shale in the semi-arid, high plateau region of the western United States has given rise to extensive efforts to develop methods of recovering shale oil from kerogen in the oil shale deposits. It should be noted that the term "oil shale" as used in the industry is, in fact, a misnomer; it is neither shale nor does it contain oil. It is a sedimentary formation comprising a marlstone deposit with layers containing an organic polymer called "kerogen" which, upon heating, decomposes to produce liquid and gaseous products, including hydrocarbon products. It is the formation containing kerogen that is called "oil shale" herein and the liquid hydrocarbon product is called "shale oil".

A number of methods have been proposed for processing oil shale which involve either mining the kerogen-bearing shale and processing the shale on the surface or processing the shale in situ. The latter approach is preferable from the standpoint of environmental impact since the spent shale remains in place, reducing the chance of surface contamination and the requirement for disposal of solid wastes. According to both of these approaches, oil shale is retorted by heating the oil shale to a sufficient temperature to decompose kerogen and produce shale oil which drains from the rock. The retorted shale, after kerogen decomposition, contains substantial amounts of residual carbonaceous material which can be burned to supply heat for retorting.

One technique for recovering shale oil includes forming an in situ oil shale retort in a subterranean formation containing oil shale. At least a portion of the formation within the boundaries of the in situ oil shale retort is explosively expanded to form a fragmented permeable mass of particles containing oil shale. The fragmented mass is ignited near the top of the retort to establish a combustion zone. An oxygen-supplying gas is introduced into the top of the retort to sustain the combustion zone and cause it to move downwardly through the fragmented permeable mass of particles in the retort. As burning proceeds, the heat of combustion is transferred to the fragmented mass of particles below the combustion zone to release shale oil and gaseous products therefrom in a retorting zone. The retorting zone moves from the top to the bottom of the retort ahead of the combustion zone and the resulting shale oil and gaseous products pass to the bottom of the retort for collection and removal. Recovery of liquid and gaseous products from oil shale deposits is described in greater detail in U.S Pat. No. 3,661,423 to Donald E. Garrett.

As used herein, the term "retorting zone" refers to that portion of the retort where kerogen in oil shale is being decomposed to liquid and gaseous products, leaving residual carbonaceous material in the retorted oil shale. The term "combustion zone" refers to a portion of the retort where the greater part of the oxygen in the retort inlet mixture that reacts with the residual carbonaceous material in the retorted oil shale is consumed.

It has been found desirable in some embodiments to have an intact subterranean base of operation above the fragmented permeable mass of formation particles in an in situ oil shale retort. Such a base of operation facilitates the drilling of blastholes into underlying formation for forming the fragmented mass in the retort and facilitates ignition over the entire top portion of the fragmented mass. Additionally, having a base of operation above the fragmented mass permits control of introduction of oxygen-supplying gas into the retort, provides a location for testing properties of the fragmented mass, such as distribution of void fraction, and provides a location for evaluation and controlling performance of the retort during operation.

The base of operation is separated from the retort by a layer of unfragmented formation extending between the top boundary of the retort and the floor of such a base of operation. The layer of unfragmented formation is termed a "sill pillar" which acts as a barrier between the in situ oil shale retort and the base of operation during retorting operations. It is, therefore, important that the sill pillar remain structurally sound, both for supporting the base of operation and for preventing entry of heat and gases into the base of operation during the retorting process.

Techniques for forming an in situ oil shale retort containing a fragmented permeable mass of formation particles and having a sill pillar of unfragmented formation between the top of the fragmented mass and an overlying base of operation are described in U.S. Pat. No. 4,118,071 by Ned M. Hutchins and in U.S. Pat. No. 4,192,554 by Thomas E. Ricketts. U.S. Pat. Nos. 4,118,071 and 4,192,554 are incorporated herein by this reference. The in situ oil shale retort formed by the method disclosed in U.S. Pat. No. 4,192,554 may not be completely full of oil shale particles, i.e., there can be a void space between the upper surface of the fragmented mass of oil shale particles and the top boundary of the retort.

In other retorts where no open base of operation is provided, the formation overlying the fragmented permeable mass of formation particles extends all the way to the ground surface. In such an embodiment, blastholes are drilled through the overlying formation and ignition of the fragmented mass of particles is accomplished from the ground surface.

Examples of other techniques used for forming in situ oil shale retorts are described in U.S. Pat. No. 4,043,595 by French; U.S. Pat. No. 4,043,596 by Ridley; U.S. Pat. No. 4,043,597 by French; and U.S. Pat. No. 4,043,598 by French et al, each of which is incorporated herein by this reference.

In the past, a variety of techniques have been developed for igniting oil shale particles in an in situ oil shale retort in order to establish a combustion zone. Such techniques are disclosed in U.S. Pat. No. 3,952,801 and U.S. Pat. No. 3,990,835, both by Robert S. Burton, III. According to the techniques disclosed in these patents, a hole is bored to the top of the fragmented permeable mass of oil shale particles and a burner is lowered through the borehole to the oil shale to be ignited. A mixture of combustible fuel, such as LPG (liquefied petroleum gas), diesel oil, or shale oil, and oxygen-containing gas, such as air, is burned in the burner to provide a hot ignition gas which is introduced into the fragmented mass of oil shale particles. The burning is continued until a substantial portion of the oil shale has been heated above its self-ignition temperature so that combustion of the oil shale in the fragmented mass is self-sustaining after ignition. Thereafter, the burner is extinguished and an oxygen-supplying gas is introduced into the retort to advance the combustion zone through the fragmented mass.

Alternatively, if desired, a lateral drift which communicates with the top region or surface of the fragmented mass can be formed through a side boundary of the retort and hot ignition gases can be introduced through the drift.

It can be important for several reasons to minimize the amount of time it takes to complete ignition of the fragmented mass in the retort.

For example, until ignition is completed, effective retorting does not take place and, thus, no products are recovered. In addition, when a void is between the overlying unfragmented formation and the fragmented mass, heating of the overlying formation during ignition can result in spalling or sloughing of the formation into the retort. This can prolong the ignition process and, in some instances, can make ignition impossible. Additionally, the sloughed formation can be heated sufficiently to consume at least a portion of the oxygen being supplied to the retort during retorting operations. This can upset the desired material balance in the retort and deleteriously affect the amount of products recovered.

If ignition time were minimized in the first instance, heating of overlying formation would be reduced and sloughing would be inhibited. Additionally, it has been found that as the time for ignition is decreased, the amount of fuel required for ignition is also decreased.

Thus, decreasing ignition time can enhance the economics of the retorting operation.

However, in addition to providing a minimized ignition time, the ignition process must also be safe.

When oil shale is heated above the pyrolysis temperature of kerogen, the kerogen decomposes to give off combustible decomposition products. The pyrolysis temperature of kerogen is considered the ignition temperature of oil shale and has been found for certain oil shales to be from about 650° F. to about 700° F.

Oxygen provided in hot ignition gases can combine with such kerogen decomposition products, thereby burning the oil shale. Burning oil shale in situ adds energy to the process and, thus, the time it takes to ignite the retort can be decreased by supplying an ignition gas that contains oxygen.

Until the ignition process is completed and the combustion zone being formed extends across the entire horizontal section of the retort, portions of the surface of the fragmented mass of formation particles are below the ignition of pyrolysis temperature of kerogen in the oil shale. As a result, some of the hot ignition gas does not come into contact with oil shale heated above its ignition temperature. Oxygen in this portion of the ignition gas is not consumed and channels down the retort. Thus, during ignition, when the oxygen concentration of the ignition gas is increased, the concentration of oxygen in retort off-gas initially increases.

Since oxygen can combine in the retort with combustible gases produced by heating of oil shale, an increase in the oxygen concentration of the hot ignition gas can result in retort off-gas comprising sufficient oxygen that it is explosive. Having an explosive off-gas is unsafe.

A process is needed, therefore, that provides an optimum concentration of oxygen in hot ignition gas for minimizing retort ignition time, while at the same time providing that the concentration of oxygen in the retort off-gas remains below a value selected with regard to safety.

SUMMARY OF THE INVENTION

This invention relates to a method for igniting an in situ oil shale retort containing a fragmented permeable mass of formation particles containing oil shale in a retort site in a subterranean formation containing oil shale. A hot ignition gas comprising oxygen at a first selected concentration is introduced into the fragmented mass of formation particles in the retort for heating the top surface of the fragmented mass to above the ignition temperature of oil shale. The percentage of the fragmented mass surface that is at a temperature less than the ignition temperature of oil shale is determined. Thereafter, the concentration of oxygen in the ignition gas is increased by an amount inversely proportional to the determined percentage.

BRIEF DESCRIPTION OF THE DRAWING

These and other features, aspects, and advantages of the present invention will become more apparent when considered with respect to the following description, appended claims, and accompanying drawing, wherein drawing illustrates, semi-schematically, a vertical cross-section of an in situ oil shale retort operated in accordance with practice of principles of this invention.

DETAILED DESCRIPTION

The retort ignition process provided in accordance with practice of principles of this invention can be understood by referring to the accompanying drawing which is a semi-schematic, vertical, cross-sectional view of an exemplary in situ oil shale retort 10 prepared for ignition. The retort 10 is in a retort site in a subterranean formation 12 containing oil shale. A fragmented permeable mass of formation particles 14 containing oil shale is contained within the top boundary 16, generally vertically extending side boundaries 18, and bottom boundary 20 of the retort. The boundaries comprise unfragmented oil shale formation.

Although the retort shown is generally rectangular in horizontal cross-section, the ignition process of this invention is useful for retorts having other configurations as well.

Access to the bottom of the exemplary retort 10 is provided through a horizontal access drift or tunnel 22 at the retort's bottom. In one embodiment, the drift 22 is first formed in the subterranean oil shale formation and a portion of the formation is then removed through the drift to form an open space in the formation which defines the bottom or floor of the retort. Unfragmented oil shale above this open space is then fragmented with explosive, both to form a cavity defined by the boundaries of the retort and to substantially fill the cavity with the fragmented mass of particles 14.

Although it is preferred that the average void fraction of the fragmented mass is between about 15 percent and about 35 percent, other void fractions can also be used. Preferably, the permeability of the fragmented mass is uniform across horizontal cross-sections of the retort to promote uniformity of gas flow and inhibit gas channeling.

If desired, access to the bottom of the oil shale retort can be provided by one or more raises which extend upwardly from a lateral drift into a bottom portion of the fragmented mass.

In the exemplary embodiment of the retort 10, there is also provided an open base of operation 24 mined into the subterranean formation above the top boundary 16. The open base of operation extends across the retort and provides effective access to substantially the entire horizontal extent of such a retort. If desired, the base of operation can be deleted and access to the top of the retort can be from the ground surface or from a drift or drifts which extend either above or adjacent the retort near the side boundaries.

A sill pillar 26 of unfragmented formation remains between the fragmented mass 14 and the open base of operation 24. The top 28 of the sill pillar is the floor of the base of operation and the bottom of the sill pillar is the top boundary 16 of the retort. When no base of operation is provided, unfragmented formation can extend all the way from the top boundary of the retort to the ground surface.

In the exemplary embodiment, there is a void space 30 between the top surface 32 of the fragmented mass and the bottom surface of unfragmented formation overlying the fragmented mass, i.e., the top boundary 16 of the retort. The retort 10 can, if desired, be provided with a fragmented mass of formation particles that substantially fills the retort all the way to the top boundary 16.

The retort 10 is ignited, i.e., a combustion zone is formed across the top surface 32 of the fragmented mass 14, by introducing a hot ignition gas into the void space 30.

In an exemplary embodiment, the hot ignition gas is introduced into the void space through one or more drifts 34 which extend laterally through a side boundary of the retort. Although only one such drift 34 is shown, if desired, a plurality of drifts or boreholes through the side boundaries can be used for introduction of the hot ignition gas.

Alternatively, if desired, the hot ignition gas can be introduced through one or more boreholes 36 which extend from the base of operation 24 through the sill pillar 26 and into the void space 30. The boreholes 36 can be blastholes used for explosively expanding unfragmented formation to form the fragmented mass or, alternatively, if desired, can be drilled in the formation after the retort is formed. During retorting, the boreholes 36 can be used for introduction of an oxygen-supplying gas which is provided to sustain and advance the combustion zone downwardly through the fragmented mass in the retort. The drift or drifts (34) can also be used for introduction of the oxygen-supplying gas.

Whether the hot ignition gas is introduced through the drift 34, as is described in the exemplary embodiment, or alternatively is introduced through one or more of the boreholes 36, the void space 30 acts as a plenum for distributing the ignition gas across the surface 32 of the fragmented mass. The ignition gas passes downwardly from the plenum 30, through the fragmented mass, and is withdrawn through the drift or retort outlet 22 which communicates with a lower portion of the fragmented mass.

The hot ignition gas is preferably exhaust gas supplied by combining fuel and an oxygen-supplying gas such as air in a burner and then igniting the mixture. Burners such as those termed "hot inert gas generators" sold by John Zinc Company of Tulsa, Oklahoma, have been found to be useful in practice of this invention. Other burners such as those described in U.S. Pat. Nos. 3,952,801 and 3,990,835 by Burton can also be used, if desired. U.S. Pat. Nos. 3,952,801 and 3,990,835 are incorporated hereinabove by reference.

Before the ignition process is started, the maximum acceptable concentration of oxygen in off-gas from the retort is determined. This determination can be made, for instance, based on guidelines promulgated by the government agency responsible for in situ oil shale retorting operations. (U.S. Department of Labor - Mine Safety and Health Administration)

The maximum acceptable concentration of oxygen in off-gas from the retort is less than the lower explosive limit. This limit for oxygen concentration depends on the composition of the off-gas which can contain various concentrations of carbon monoxide, hydrogen, methane, and other combustible hydrocarbons and the like. Off-gas from several retorts may be commingled and such combustibles are essentially always present; hence, the composition is maintained below the lower explosive limit of such off-gas by controlling oxygen concentration in off-gas from a retort being ignited. The maximum acceptable concentration of oxygen in the off-gas can be appreciably below the lower explosive limit to provide a safety margin against developing a hazardous condition.

As mentioned above, it is preferable that retort ignition is completed as rapidly as possible to minimize heating of the top boundary 16 and, thus, inhibit sloughing of formation into the retort. Since oil shale heated above its ignition temperature will burn in the presence of oxygen, thereby imparting in situ heat to the process and, thus, enhancing the rate of spread of the combustion zone across the surface of the fragmented mass, it is desirable that the ignition gas comprise oxygen. To maximize the rate of combustion zone spread, the concentration of oxygen in the ignition gas is preferably as high as possible consistent with maintaining the concentration of oxygen in the retort off-gas below the predetermined maximum acceptable concentration. Using oxygen in the ignition gas not only creates heat for ignition where it will do the most good, in the fragmented mass being ignited, but it also results in the use of raw oil shale as fuel for ignition, thereby reducing the requirement for more expensive fuels in the burners.

In one exemplary embodiment of the ignition process of this invention, a burner (not shown) is positioned in the drift 34. A fuel/air mixture is supplied to the burner and ignited to provide a hot ignition gas comprising oxygen at a first selected concentration. The ignition gas is introduced into the void space 30 for heating the surface of the fragmented mass, to thereby establish the combustion zone in the retort.

At the start of the ignition process, i.e., when the hot ignition gas is first introduced into the retort, none of the oil shale at the surface of the fragmented mass is at a temperature sufficiently high to consume any oxygen in the ignition gas. Thus, the retort off-gas that results from initial heating of the oil shale has an oxygen concentration that is about the same as the oxygen concentration of the hot ignition gas introduced into the retort. It is, therefore, desirable that the first selected concentration of oxygen in the ignition gas is no greater than the maximum acceptable concentration of oxygen in the off-gas. Because it is also desirable to maximize the rate of spread of the combustion zone horizontally across the fragmented mass, it is most preferred that the first selected oxygen concentration in the hot ignition gas is about equal to the maximum acceptable concentration of oxygen in the off-gas. Lower concentrations can be used, if desired.

For purposes of exposition herein, one exemplary embodiment is described below based on a maximum acceptable concentration of oxygen in retort off-gas of 2.5% by volume. Thus, the preferred first selected concentration of oxygen in the ignition gas for this embodiment is about 2.5%. It should be understood, however, that the process provided in accordance with this invention is also applicable for any higher or lower maximum acceptable retort off-gas oxygen concentrations.

Fuel and air are introduced to the burner in the drift 34 for providing an ignition gas at a temperature of about 1600° F. and having the first selected oxygen concentration of about 2.5%. Although, in the exemplary embodiment, the ignition gas is at 1600° F., ignition gas can be provided at higher or lower temperatures as desired.

The ignition gas contacts the surface of the fragmented mass and begins heating the oil shale at the surface to above the ignition temperature of oil shale (about 650° F.–700° F.).

As mentioned above, at the start of the process, the oxygen concentration of the off-gas is about the same as the oxygen concentration of the ignition gas (about 2.5% in this instance) because until at least a portion of the fragmented mass surface is above the oil shale ignition temperature, little, if any, oxygen is consumed. As the ignition process continues, the percentage of the surface of the fragmented mass heated to at least the ignition temperature of oil shale increases due to continued introduction of the hot ignition gas. Oxygen in that portion of the ignition gas that contacts oil shale heated to no less than its ignition temperature is consumed. On the other hand, oxygen in that portion of the ignition gas that passes through regions of the fragmented mass surface that are below the oil shale ignition temperature is not consumed and remains in the retort off-gas. Thus, the value of the ratio of the concentration of oxygen in the off-gas to the concentration of oxygen in the ignition gas is about equal to the fraction of the surface of the fragmented mass that is not ignited, i.e., the fraction that has not been heated above its ignition temperature.

During ignition, the percentage or fraction of the fragmented mass surface that is at a temperature no less than the ignition temperature of oil shale is determined. After such a determination is made, the concentration of oxygen in the ignition gas is increased to above the first selected concentration, preferably by an amount proportioned in accordance with the determined percentage. More specifically, the concentration of oxygen in the ignition gas is preferably increased by an amount inversely proportional to the fraction of the fragmented mass not ignited.

Increases in the concentration of oxygen in the ignition gas can be accomplished in a series of steps where the concentration of oxygen at each step is based on the fraction of the fragmented mass surface that is ignited. The steps can be as large or small as desired. If the steps are small enough, for example, the process tends to be "continuous".

In one exemplary embodiment, the percentage of the surface of the fragmented mass that is ignited is determined by monitoring a plurality of thermocouples spaced uniformly across an upper portion of the fragmented mass.

Preferably, however, the percentage of the fragmented mass surface that is ignited is determined by withdrawing off-gas from the retort and comparing the concentration of oxygen in the off-gas to the concentration of oxygen in the ignition gas. For example, when the value of the concentration of oxygen in the off-gas is about three-fourths the value of the concentration of oxygen in the ignition gas, about one-fourth of the fragmented mass surface is ignited.

Preferably, the oxygen concentration in the off-gas during most of the ignition period is more than about one-half the maximum acceptable oxygen concentration. If the oxygen concentration decreases below about one-half the maximum acceptable concentration, the total time required for ignition can increase to the extent that sloughing of overlying unfragmented formation can become significant. Sufficient oxygen concentration is provided in the ignition gas to maintain the oxygen concentration in the range of from about one-half the maximum acceptable oxygen concentration to about the maximum acceptable oxygen concentration.

In an exemplary embodiment, when the concentration of oxygen in the off-gas decreases from its original value of about 2.5% to about 1.25% (thus indicating that about one-half the surface is ignited), the oxygen concentration in the ignition gas is increased to a second selected concentration. This is accomplished by changing the fuel/air ratio in the burner feed.

The second selected concentration of oxygen in the hot ignition gas is preferably no more than about the value of the maximum acceptable concentration of oxygen in the retort off-gas times 100 divided by 100 minus X, wherein X is the percentage of the fragmented mass surface that is ignited. If the second selected concentration of oxygen in the ignition gas is greater than about the above described value, the concentration of oxygen in the off-gas can be higher than the maximum acceptable value.

As mentioned above, it is also desired that the concentration of oxygen in the ignition gas is as high as possible to maximize the rate of spread of the combustion zone, yet is sufficiently low so that the maximum acceptable off-gas oxygen concentration is not exceeded. Thus, preferably the second selected concentration of oxygen in the hot ignition gas is about 5%.

After the concentration of oxygen in the ignition gas is increased to the second selected concentration of about 5%, the off-gas oxygen concentration initially increases, levels off below about 2.5%, and then begins to fall as additional area is ignited.

In one embodiment, when the oxygen concentration in the retort off-gas again falls to about 1.25% (indicating that about ¾ of the fragmented mass surface is ignited), the oxygen concentration in the ignition gas is increased to a third selected concentration.

As was the case for the second selected concentration, the third selected concentration of oxygen in the hot ignition gas is preferably no more than about the value of the maximum acceptable concentration of oxygen in the retort off-gas times 100 divided by 100 minus X, wherein X is as defined above. Since it is also desired that the third selected concentration is as high as possible for maximizing the rate of combustion zone spread without causing the off-gas oxygen concentration to exceed the maximum acceptable value, the third selected concentration of oxygen in the ignition gas is preferably about 10%.

It has been found that within a short time, i.e., several hours or less after the oxygen concentration in the hot ignition gas is increased to about 10%, the entire surface of the fragmented mass is ignited, i.e., the combustion zone has spread across substantially the entire horizontal extent of the retort.

After developing experience in igniting retorts of known characteristics, control of oxygen concentration can be based on time rather than direct measurement of temperature or oxygen in the off-gas. The time needed to ignite a selected area of the retort is reasonably consistent when the parameters are consistent. Parameters of concern include ignition gas temperature, flow rate, composition and distribution to the top of the fragmented mass, particle size and grade of oil shale near the top surface, void fraction and void fraction distribution in the fragmented mass, absence of abnormal sloughing of overlying formation, and the like. Thus, after several similar retorts have been ignited, it will be known that the oxygen concentration in the off-gas decreases to about one-half the concentration in the ignition gas in a certain time interval, e.g., eight to sixteen hours. Once that is determined, such an interval can be used as an indirect determination of the extent of ignition rather than making a direct measurement of temperature or off-gas oxygen concentration. Such intervals can be used for each stage of increasing oxygen concentration.

After it is determined that the combustion zone has spread as desired across the fragmented mass surface (based either on temperature readings from an array of thermocouples in the retort or on the concentration of oxygen in the off-gas falling to about zero), the burner is extinguished. Alternatively, if desired, the burner can be extinguished a selected period of time after the concentration of oxygen in the ignition gas is increased to the 10% level. This selected time period can, for example, be after two or three retort gas residence times during which the oxygen concentration in the off-gas remains below the maximum acceptable value. As used herein, "residence time" is the average time a unit of gas remains in the retort at the flow rate of gas through the retort. Stated otherwise, average residence time is the volumetric flow rate of gas divided by the total volume of void space in the fragmented mass in the retort.

It is believed that by practice of principles of this invention, using a hot ignition gas at a temperature of about 1600° F. and at a superficial velocity of about 1.14 standard cubic feet per minute (SCFM) per square foot of fragmented mass surface, the entire fragmented mass surface can be ignited in about one day. Thus, by practice of this invention for maximizing the concentration of oxygen in the ignition gas, the time for ignition is minimized and heating and resultant sloughing of formation into the retort is inhibited.

After the burner is extinguished, a retort inlet mixture comprising an oxygen-supplying gas such as air, oxygen-enriched air, air diluted with off-gas or steam, or the like is introduced into the retort either through one or more of the boreholes 36 or through the drift 34. The oxygen-supplying gas sustains the combustion zone and advances the combustion zone and a retorting zone on the advancing side of the combustion zone downwardly through the fragmented mass of formation particles. Kerogen in the oil shale is retorted in the retorting zone to produce liquid and gaseous products which are withdrawn through the retort outlet 22. The oxygen concentration in the retort inlet mixture can have any desired value after the entire area of the retort is ignited and does not form part of this invention.

Although, in the exemplary embodiment, the ignition gas oxygen concentration is increased from 2.5% to 5%, then to 10%, increases of other magnitude can be used. For instance, the percentage of oxygen in the ignition gas can, if desired, be increased in increments of 1% or 2% until the exemplary 10% concentration is reached. Also, if desired, the concentration of oxygen in the ignition gas can be increased to greater than 10% prior to extinguishing the burner. In each instance, the preferred value of the ignition gas oxygen concentration is based on the fraction of the fragmented mass surface that is ignited.

The above description of a method for igniting an in situ oil shale retort in a subterranean formation containing oil shale is for illustrative purposes. Because of variations which will be apparent to those skilled in the art, the present invention is not intended to be limited to the particular embodiment described hereinabove. The scope of the invention is defined in the following claims.

What is claimed is:

1. A method for igniting an in situ oil shale retort containing a fragmented permeable mass of formation particles containing oil shale in a retort site in a subterranean formation containing oil shale, the method comprising the steps of:

(a) introducing into a fragmented permeable mass of formation particles in an in situ oil shale retort, a hot ignition gas comprising oxygen at a selected concentration for heating the top surface of the fragmented mass;

(b) determining the percentage of the fragmented mass top surface that is at a temperature less than the ignition temperature of oil shale; and thereafter (c) increasing the concentration of oxygen in the ignition gas by an amount inversely proportional to the percentage determined in step (b).

2. The method according to claim 1 comprising monitoring the temperature of the top surface of the fragmented mass for determining the percentage of the fragmented mass top surface that is at a temperature less than the ignition temperature of oil shale.

3. The method according to claim 1 comprising the step of withdrawing an off-gas from such an in situ oil shale retort and wherein the selected concentration of oxygen in the ignition gas is less than the lower explosive limit of oxygen in such off-gas.

4. The method according to claim 1 comprising the steps of:

withdrawing an off-gas from such an in situ oil shale retort; and providing a sufficient concentration of oxygen in the ignition gas for maintaining the oxygen concentration in the off-gas above about one-half the selected concentration.

5. The method according to claim 1 comprising the steps of:

withdrawing an off-gas from the retort and monitoring the concentration of oxygen in such retort off-gas; and correlating the ratio of the concentration of oxygen in the retort off-gas to the concentration of oxygen in the ignition gas for determining the percentage of the fragmented mass surface that is at a temperature less than the ignition temperature of oil shale, the value of the ratio of the concentration of oxygen in the off-gas to the concentration of oxygen in the ignition gas being about equal to the percentage of the fragmented mass top surface that is at a temperature less than the ignition temperature of oil shale.

6. The method according to claim 1 wherein the selected concentration of oxygen in the hot ignition gas is no greater than about 2.5% by volume.

7. A method for igniting an in situ oil shale retort containing a fragmented permeable mass of formation particles containing oil shale in a retort site in a subterranean formation containing oil shale, the method comprising the steps of:

(a) determining the maximum acceptable concentration of oxygen in off-gas from the retort;

(b) introducing a hot ignition gas comprising oxygen at a first selected concentration into the fragmented permeable mass of formation particles in the retort for heating the top surface of the fragmented mass;

(c) determining the percentage of the fragmented mass top surface that is at a temperature no less than the ignition temperature of oil shale; and thereafter (d) increasing the amount of oxygen in the ignition gas to a second selected concentration, the second selected concentration being no more than about the value of the maximum acceptable concentration of oxygen determined in step (a) times (100/100-X), wherein X is the percentage of the fragmented mass top surface that is at a temperature no less than the ignition temperature of oil shale as determined in step (c).

8. The process according to claim 7 wherein the first selected concentration of oxygen in the hot ignition gas is about equal to the maximum acceptable concentration of oxygen in off-gas from such a retort.

9. The method according to claim 7 comprising the step of withdrawing an off-gas from such an in situ oil shale retort and wherein the first selected concentration of oxygen in the ignition gas is less than the lower explosive limit of oxygen in such off-gas.

10. The method according to claim 7 comprising the steps of:

withdrawing an off-gas from such an in situ oil shale retort; and providing a sufficient concentration of oxygen in the ignition gas for maintaining the oxygen concentration in the off-gas above about one-half the first selected concentration.

11. The method according to claim 7 comprising monitoring the temperature of the top surface of the fragmented mass for determining the percentage of the fragmented mass top surface that is at a temperature no less than the ignition temperature of oil shale.

12. The method according to claim 7 comprising the steps of:

withdrawing an off-gas from the retort and monitoring the concentration of oxygen in such retort off-gas; and correlating the ratio of the concentration of oxygen in the retort off-gas to the concentration of oxygen in the ignition gas for determining the percentage of the fragmented mass surface that is at a temperature no less than the ignition temperature of oil shale, the value of the ratio of the concentration of oxygen in the off-gas to the concentration of oxygen in the ignition gas being about inversely proportional to the percentage of the fragmented mass top surface that is at a temperature no less than the ignition temperature of oil shale.

13. A method for igniting an in situ oil shale retort containing a fragmented permeable mass of formation particles containing oil shale in a retort site in a subterranean formation containing oil shale, the method comprising the steps of:

(a) introducing a hot ignition gas comprising oxygen at a concentration of about 2.5% by volume into a fragmented permeable mass of formation particles in an in situ oil shale retort for heating the top surface of the fragmented permeable mass;

(b) withdrawing an off-gas from the retort and monitoring the concentration of oxygen in such retort off-gas;

(c) when the concentration of oxygen in the retort off-gas is below about one-half the concentration of oxygen in the ignition gas, increasing the concentration of oxygen in the ignition gas to about 5% by volume, thereby increasing the oxygen concentration in the retort off-gas; and thereafter (d) when the concentration of oxygen in the retort off-gas falls to below about one-fourth the concentration of oxygen in the ignition gas, increasing the concentration of oxygen in the ignition gas to about 10% by volume.

14. A method for igniting an in situ oil shale retort containing a fragmented permeable mass of formation particles containing oil shale in a retort site in a subterranean formation containing oil shale, the method comprising the steps of:

(a) introducing a hot ignition gas comprising oxygen at a concentration of about 2.5% by volume into a fragmented permeable mass of formation particles in an in situ oil shale retort for heating the top surface of the fragmented mass;

(b) monitoring the temperature of the top surface of the fragmented mass;

(c) withdrawing an off-gas from the retort and monitoring the concentration of oxygen in such retort off-gas;

(d) when about one-half of the top surface of the fragmented mass has been heated to a temperature no less than about 650° F., increasing the concentration of oxygen in the hot ignition gas to about 5% by volume, thereby increasing the oxygen concentration in the retort off-gas; and thereafter (e) when the oxygen concentration in the retort off-gas falls to less than a first preselected value, increasing the concentration of oxygen in the hot ignition gas to about 10% by volume.

15. The method according to claim 14 wherein the first preselected value of the concentration of oxygen in the retort off-gas is about one-and-one-quarter percent.

16. A method for igniting an in situ oil shale retort containing a fragmented permeable mass of formation particles containing oil shale in a retort site in a subterranean formation containing oil shale, the method comprising the steps of:

(a) introducing a hot ignition gas comprising oxygen at a concentration of about 2.5% by volume into a fragmented permeable mass of formation particles in an in situ oil shale retort for heating the top surface of the fragmented mass;

(b) monitoring the temperature of the top surface of the fragmented mass;

(c) withdrawing an off-gas from the retort and monitoring the concentration of oxygen in such retort off-gas;

(d) when about one-half of the top surface of the fragmented mass has been heated to a temperature no less than about 650° F., increasing the concentration of oxygen in the hot ignition gas to about 5% by volume, thereby increasing the oxygen concentration in the retort off-gas; and thereafter (e) when about three-fourths of the top surface of the fragmented mass has been heated to a temperature no less than about 650° F., increasing the concentration of oxygen in the hot ignition gas to about 10% by volume.

17. A method for igniting an in situ oil shale retort containing a fragmented permeable mass of formation particles containing oil shale in a retort site in the subterranean formation containing oil shale, the method comprising the steps of:

(a) determining the maximum acceptable concentration of oxygen in off-gas from the retort;

(b) introducing a hot ignition gas comprising oxygen at a first selected concentration into the fragmented permeable mass of formation particles in the retort for heating the top surface of the fragmented mass, wherein the first selected concentration of oxygen is no greater than the maximum acceptable concentration of oxygen determined in step (a);

(c) determining the percentage of the fragmented mass top surface that is at a temperature less than the ignition temperature of oil shale; and thereafter (d) increasing the concentration of oxygen in the ignition gas by an amount inversely proportional to the percentage determined in step (c).

18. The method according to claim 17 comprising the step of withdrawing an off-gas from such an in situ oil shale retort and wherein the first selected concentration of oxygen in the ignition gas is less than the lower explosive limit of oxygen in such off-gas.

19. The method according to claim 17 comprising the steps of:

withdrawing an off-gas from such an in situ oil shale retort; and providing a sufficient concentration of oxygen in the ignition gas for maintaining the oxygen concentration in the off-gas above about one-half the first selected concentration.

20. The process according to claim 17 wherein the first selected concentration of oxygen in the hot ignition gas is about equal to the maximum acceptable concentration of oxygen in off-gas from the retort.

21. The method according to claim 17 comprising monitoring the temperature of the top surface of the fragmented mass for determining the percentage of the fragmented mass top surface that is at a temperature less than the ignition temperature of oil shale.

22. The method according to claim 17 comprising the steps of:

withdrawing an off-gas from the retort and monitoring the concentration of oxygen in such retort off-gas; and correlating the ratio of the concentration of oxygen in the retort off-gas to the concentration of oxygen in the ignition gas for determining the percentage of the fragmented mass surface that is at a temperature less than the ignition temperature of oil shale, the ratio of the concentration of oxygen in the off-gas to the concentration of oxygen in the ignition gas being about equal to the percentage of the fragmented mass top surface that is at a temperature less than the ignition temperature of oil shale.

23. A method for recovering liquid and gaseous products from an in situ oil shale retort containing a fragmented permeable mass of formation particles containing oil shale and having top, bottom, and side boundaries of unfragmented formation, the method comprising the steps of:

(a) excavating a void in a subterranean formation within the boundaries of the in situ oil shale retort to be formed;

(b) explosively expanding formation remaining within the boundaries toward the void for forming an in situ oil shale retort containing a fragmented permeable mass of formation particles containing oil shale;

(c) establishing a combustion zone in the retort by the steps of:

(i) determining the maximum acceptable concentration of oxygen in off-gas from the retort;

(ii) introducing a hot ignition gas comprising oxygen at a first selected concentration into the fragmented permeable mass of formation particles for heating the top surface of the fragmented mass to thereby establish a combustion zone across the fragmented mass top surface, said first selected concentration being no more than the maximum acceptable concentration of oxygen in off-gas from the retort;

(iii) determining the percentage of the fragmented mass surface that is at a temperature less than the ignition temperature of oil shale; and (iv) increasing the concentration of oxygen in the ignition gas by an amount inversely proportional to the percentage determined in step (c)(iii);

(d) introducing into the fragmented mass an oxygen-supplying gas and withdrawing from a lower portion of the fragmented mass an off-gas for advancing the combustion zone downwardly through the retort to thereby produce liquid and gaseous products on the advancing side of the combustion zone; and (e) recovering the liquid and gaseous products from the retort.

24. The process according to claim 23 wherein the first selected concentration of oxygen in the hot ignition gas is about equal to the maximum acceptable concentration of oxygen in off-gas from the retort.

25. The method according to claim 23 comprising the step of withdrawing an off-gas from such an in situ oil shale retort and wherein the first selected concentration of oxygen in the ignition gas is less than the lower explosive limit of oxygen in such off-gas.

26. The method according to claim 23 comprising the steps of:

withdrawing an off-gas from such an in situ oil shale retort; and providing a sufficient concentration of oxygen in the ignition gas for maintaining the oxygen concentration in the off-gas above about one-half the selected concentration.

27. A method for igniting an in situ oil shale retort containing a fragmented permeable mass of formation particles containing oil shale in a retort site in a subterranean formation containing oil shale, the method comprising the steps of:

(a) determining the maximum acceptable oxygen concentration in off-gas from the retort;

(b) introducing a hot ignition gas comprising oxygen at a first concentration no more than the maximum acceptable off-gas oxygen concentration into the fragmented permeable mass of formation particles in the retort;

(c) withdrawing an off-gas from such an in situ oil shale retort; and (d) providing a sufficient oxygen concentration in the ignition gas for maintaining the oxygen concentration in such off-gas in the range of from about one-half the maximum acceptable concentration to no more than the maximum acceptable concentration.

28. A method for igniting an in situ oil shale retort containing a fragmented permeable mass of formation particles containing oil shale in a retort site in a subterranean formation containing oil shale, the method comprising the steps of:

(a) determining the maximum acceptable oxygen concentration in off-gas from the retort;

(b) introducing a hot ignition gas comprising oxygen at no more than the maximum acceptable off-gas concentration into the fragmented permeable mass of formation particles in the retort for heating the top surface of the fragmented mass and withdrawing an off-gas from such an in situ oil shale retort; and thereafter (c) when only a portion of the top surface of the fragmented mass is at a temperature no less than the ignition temperature of oil shale, increasing the oxygen concentration of the ignition gas while maintaining the oxygen concentration in the off-gas no higher than the maximum acceptable concentration.

29. A method for igniting an in situ oil shale retort containing a fragmented permeable mass of formation particles containing oil shale in a retort site in the subterranean formation containing oil shale, the method comprising the steps of:

(a) determining the maximum acceptable concentration of oxygen in off-gas from the retort;

(b) introducing into the fragmented permeable mass of formation particles in the retort a hot ignition gas comprising oxygen at a first selected concentration for heating the top surface of the fragmented mass, wherein the first selected concentration of oxygen is no greater than the maximum acceptable concentration of oxygen determined in step (a); and (c) when only a portion of the fragmented mass top surface is at a temperature no less than the ignition temperature of oil shale, increasing the concentration of oxygen in the ignition gas in proportion to the area of the top surface that is at a temperature no less than the ignition temperature of oil shale.

30. The method according to claim 29 comprising the step of withdrawing an off-gas from such an in situ oil shale retort and wherein the first selected concentration of oxygen in the ignition gas is less than the lower explosive limit of oxygen in such off-gas.

31. The method according to claim 29 comprising the steps of:

withdrawing an off-gas from such an in situ oil shale retort; and providing a sufficient concentration of oxygen in the ignition gas for maintaining the oxygen concentration in the off-gas above about one-half the first selected concentration.

* * * * *